US006788622B1

(12) United States Patent
Garcia

(10) Patent No.: US 6,788,622 B1
(45) Date of Patent: Sep. 7, 2004

(54) GLOBAL TIME INDICATOR

(76) Inventor: Eddie M. Garcia, 5546 Oak Glen Rd., Edina, MN (US) 55439

( * ) Notice: Subject to any disclaimer, the term of this patent is extended or adjusted under 35 U.S.C. 154(b) by 259 days.

(21) Appl. No.: 10/147,939

(22) Filed: May 17, 2002

Related U.S. Application Data

(60) Provisional application No. 60/291,786, filed on May 17, 2001.

(51) Int. Cl.[7] ..... G04B 19/22

(52) U.S. Cl. ..... 368/21; 368/22; 368/27

(58) Field of Search ..... 368/21–27, 77, 368/233–235; 116/308

(56) References Cited

U.S. PATENT DOCUMENTS

| | | | | | |
|---|---|---|---|---|---|
| 1,344,913 | A | * | 6/1920 | Long | 368/27 |
| 1,607,560 | A | | 11/1926 | Pennino | |
| D141,710 | S | | 6/1945 | Guttmann | |
| 2,463,758 | A | | 3/1949 | Freel | |
| D181,407 | S | | 11/1957 | Chamberlin | |
| 3,115,002 | A | * | 12/1963 | Beresford | 368/27 |
| 3,190,257 | A | * | 6/1965 | Blythe, Jr. | 116/318 |
| 3,858,334 | A | * | 1/1975 | Eisenhauer | 424/285 |
| 3,936,957 | A | | 2/1976 | Nordbye | |
| 4,032,754 | A | * | 6/1977 | Ageton | 235/78 R |
| D289,905 | S | * | 5/1987 | Goldring | D19/25 |
| 4,847,819 | A | | 7/1989 | Hong | |
| 4,974,217 | A | * | 11/1990 | Inoue | 368/108 |
| 5,054,008 | A | | 10/1991 | Darling | |
| 6,006,986 | A | | 12/1999 | Whalen | |

* cited by examiner

*Primary Examiner*—David Martin
*Assistant Examiner*—Thanh S. Phan

(57) ABSTRACT

A global time indicating calculator has a rotating dial for calculating global standard time and advanced time in various international time zones. Indicia printed on the face of the dial and corresponding sections of the face of the calculator can be easily referenced to determine time of day at selected locations throughout the world. The calculator is used by dialing present time and reading the indicia to determine time at a different local. The dial has an outer annular ring marked with numerical indicia and scale indicia along its circumference for measuring time at selected increments. The time indicia is matched with selected geographical region to calculate the time of day worldwide.

15 Claims, 10 Drawing Sheets

GLOBAL TIME INDICATOR

CROSS REFERENCE TO RELATED APPLICATION

This application claims the benefit of U.S. Provisional Application Serial No. 60/291,786 filed May 17, 2001.

FIELD OF THE INVENTION

The invention is in the art of timing devices, particularly time keeping devices which indicate international or global time.

BACKGROUND OF THE INVENTION

Worldwide there are twenty-four different geographical regions within which a different standard time is used. In the United States there are four different time zones; Pacific, Mountain, Central and Eastern time zones. Often there is a need to determine time of day or night at various locations or geographical regions when traveling, or when making interregional telephone calls, e-mails, facsimiles and the like. Also, certain localities have advanced time or daylight savings time, which is a time usually one hour ahead of standard time at various times of year to maximize daylight hours. The global time indicator of the invention avoids the need for repeated calculation of time throughout the world.

SUMMARY OF THE INVENTION

The indicator of the invention is used to indicate international time by dialing present local time and reading indicia on the face of the indicator to determine time at a different locale. Repeated time determinations are fast and accurate.

The indicator is a hand held or bag tag member having a front wall and a back wall accommodating a dial used to indicate time. The dial has an outer annular ring marked with numerical indicia and scale indicia along its circumference for measuring time at selected increments. When the dial is manually rotated to indicate present local time, times at various other geographical regions are displayed.

A modification of the indicator is a wall mounted international time indicator having a clock mechanism rotating a dial for indicating time of day. The dial has numerical and scale indicia for measuring time. The indicia on the dial are compared to printed matter and line indicia on the cover of the indicator to determine time in other parts of the globe at one glance.

A second modification of the indicator is a desk supported time indicator having a time dial rotated by a clock mechanism. A base is used to support the indicator on a horizontal surface such as a desktop.

DESCRIPTION OF PREFERRED EMBODIMENTS

Figure 1:
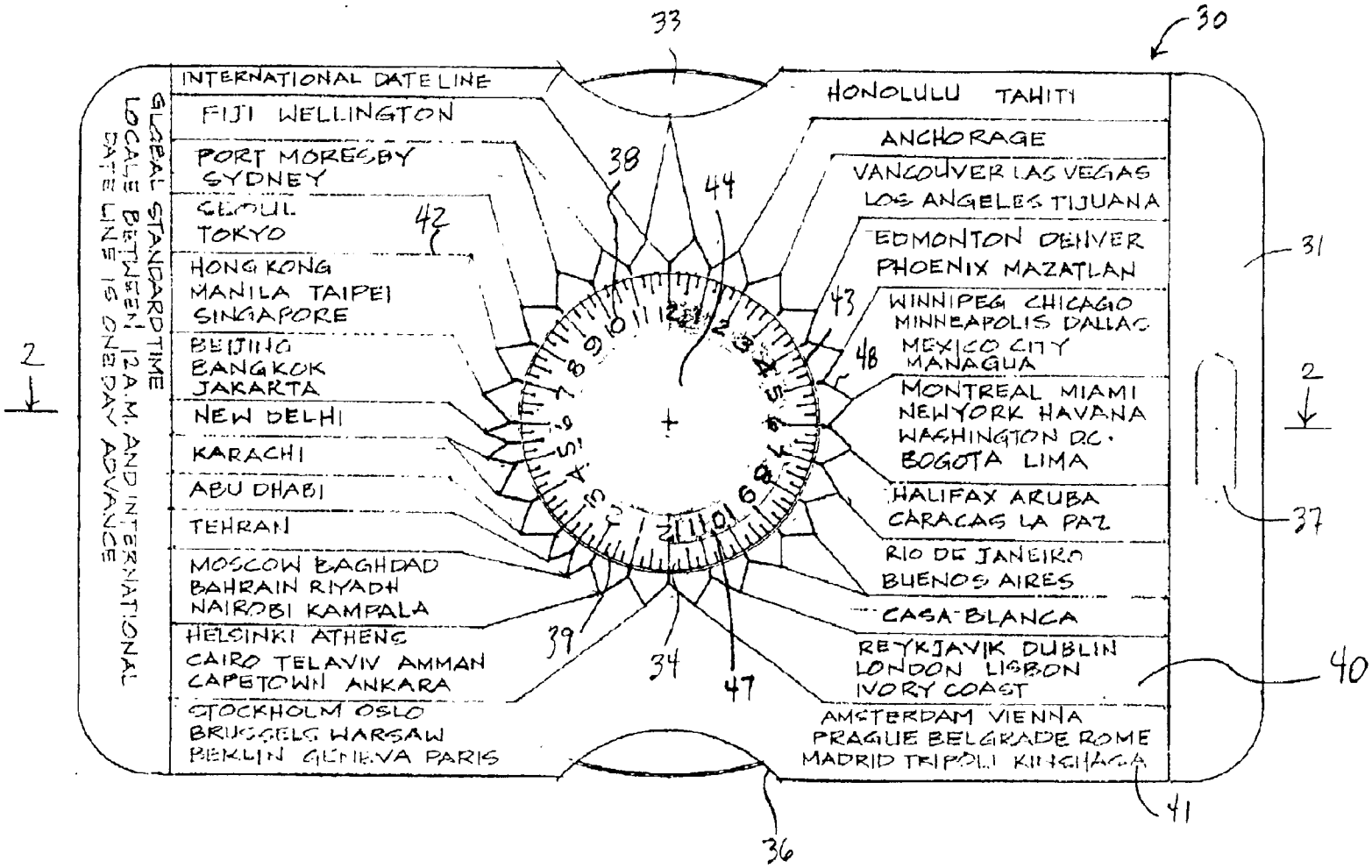
FIG. 1 is a front elevational view of the global time indicator of the invention.
Figure 2:
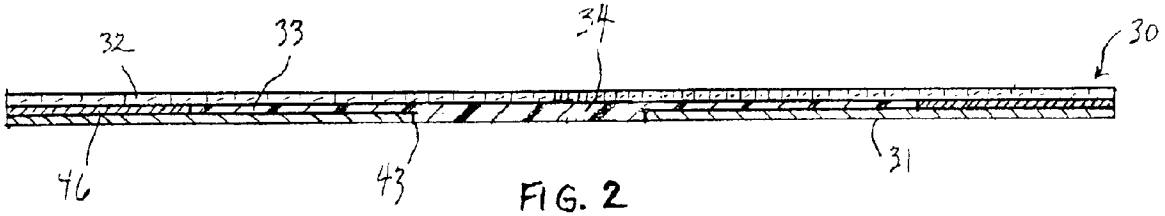
FIG. 2 is a sectional view taken along line 2—2 of FIG. 1.
Figure 4:
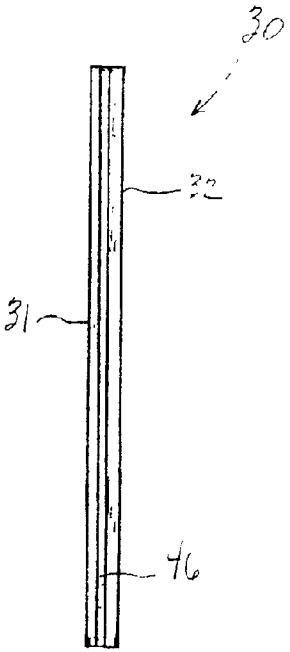
FIG. 4 is a right side view thereof.
Figure 3:
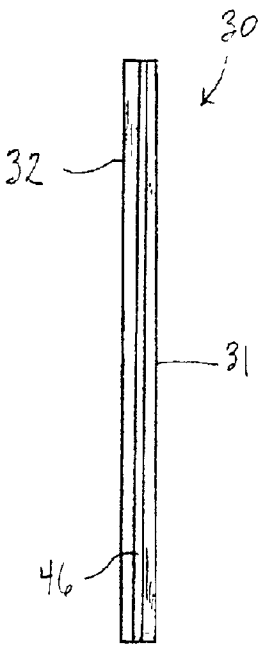
FIG. 3 is a left side view thereof.
Figure 5:
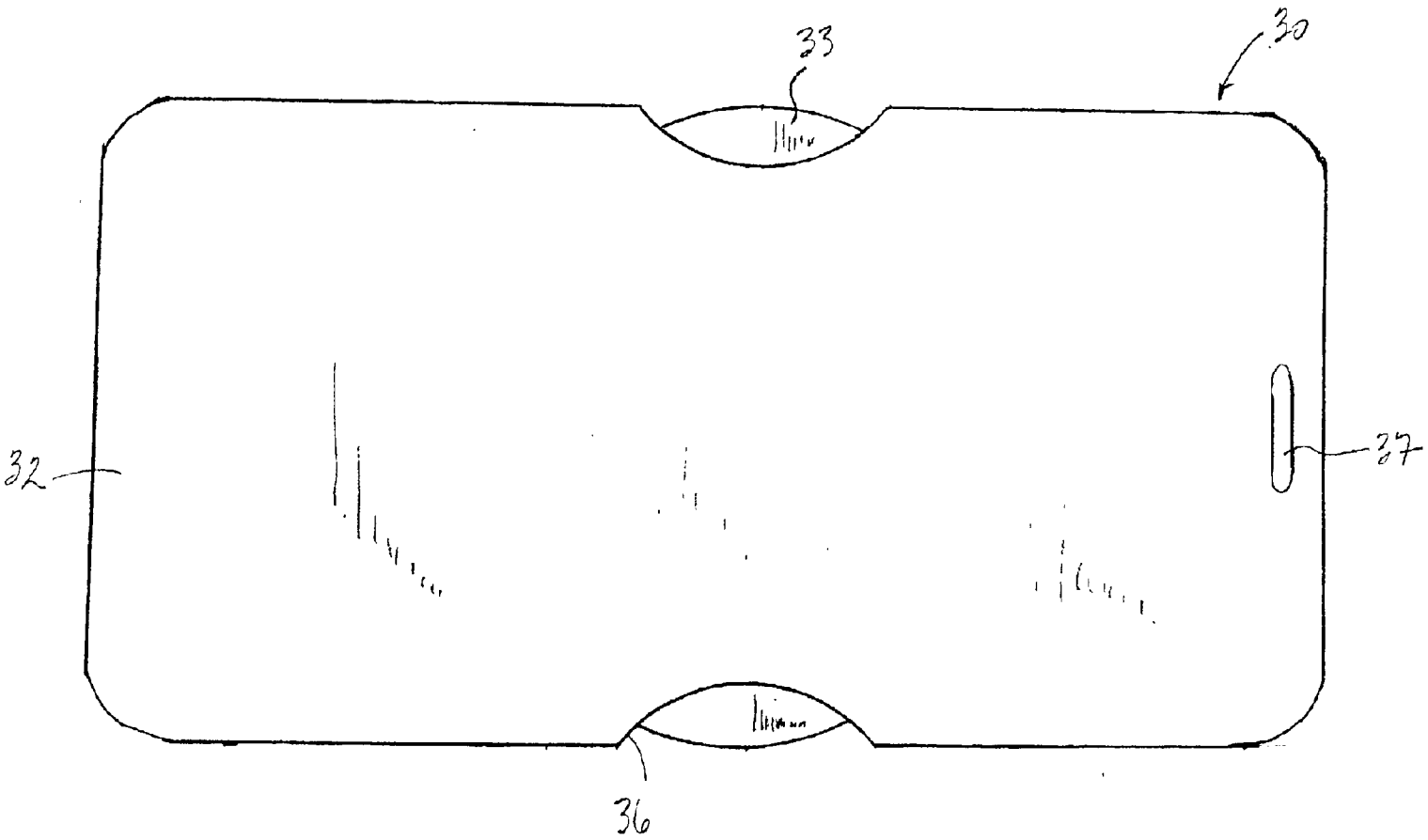
FIG. 5 is a rear plan view thereof.

Referring to FIGS. 1 to 5, there is shown a time indicator 30 of the invention. Indicator 30 is used to indicate global time at various worldwide locations. Indicator 30 has a rectangular front wall 31 and rectangular back wall 32 accommodating a dial 33 having a generally circular outwardly projecting hub 34 having numerical indicia 38 and scale indicia 39 to indicate time of day. Numerical indicia 38 and scale indicia 39 indicate two equal 12-hour periods in 15 minute increments. Hub 34 has a shaded portion 47 to differentiate the afternoon and evening 12-hour period from the morning 12-hour period. It may be desirable to have numerical indicia indicating one 24-hour time period. Front wall 31 has an opening 43 for accommodating hub 34 of dial 33. The center 44 of hub 34 may have advertising or a company logo imprinted thereon. Walls 31 and 32 and dial 33 are constructed of semi-rigid material, such plastic or cardboard joined with an adhesive 46. Indicator 30 is preferably a three-piece laminated plastic or layered structure. Back wall 32 can be lined with magnetic material for attachment to magnetic attracting surfaces such as refrigerator surfaces. Back wall 32 can also have indicia and printed material similar to indicia 142 and printed matter 141 printed on wall 131 of indicator 130 to reference advanced time or day light savings time. Wall 32 can have a center opening to expose numerical and scale indicia which may be printed on the opposite side of hub 34 for calculating international time zones during advanced time periods. Indicator 30 can have other dimensions and be made of other types of semi-rigid materials. The opposite side edges of walls 31 and 32 have recesses or grooves 36 to expose the outer annular edge of dial 33. Dial 33 is manually rotated to indicate present local time whereby the time of day of other international locations can be determined at one glance. Front wall 31 has uniform thickness with a flat top surface having line markings or indicia 42 forming a plurality of generally rectangular shaped vertically disposed sections or boxes 40. Each box 40 represents a geographical region within which the same standard time is used. Horizontally disposed printed matter 41 located in boxes 40 identifies localities, such as major metropolitan areas, capital cities, and ports within each geographical region whereby quick reference may be made to determine the relative time of the various localities. Y-shaped angle bracket members 48 closing the ends of the boxes 40 are located adjacent time indicia 38 and 39 on hub 34 to facilitate alignment of the time indicia 38 and 39 with the corresponding box 40. Indicator 30 has a slot 37 for accommodating a chain or strap for attachment to luggage or a briefcase.

Figure 6:
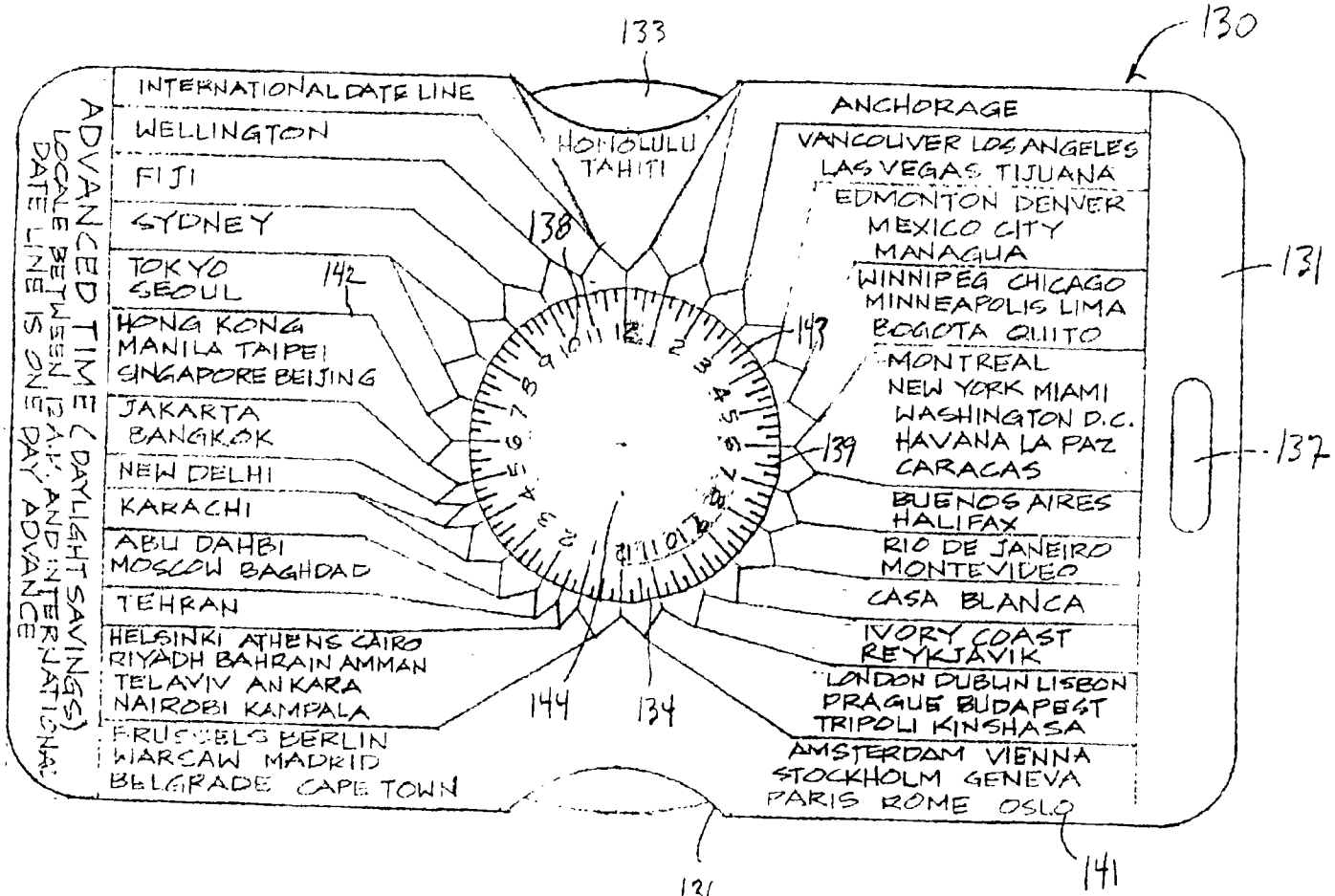
FIG. 6 is a front elevational view of the global time indicator of FIG. 1 having indicia indicating advanced time.
Figure 7:
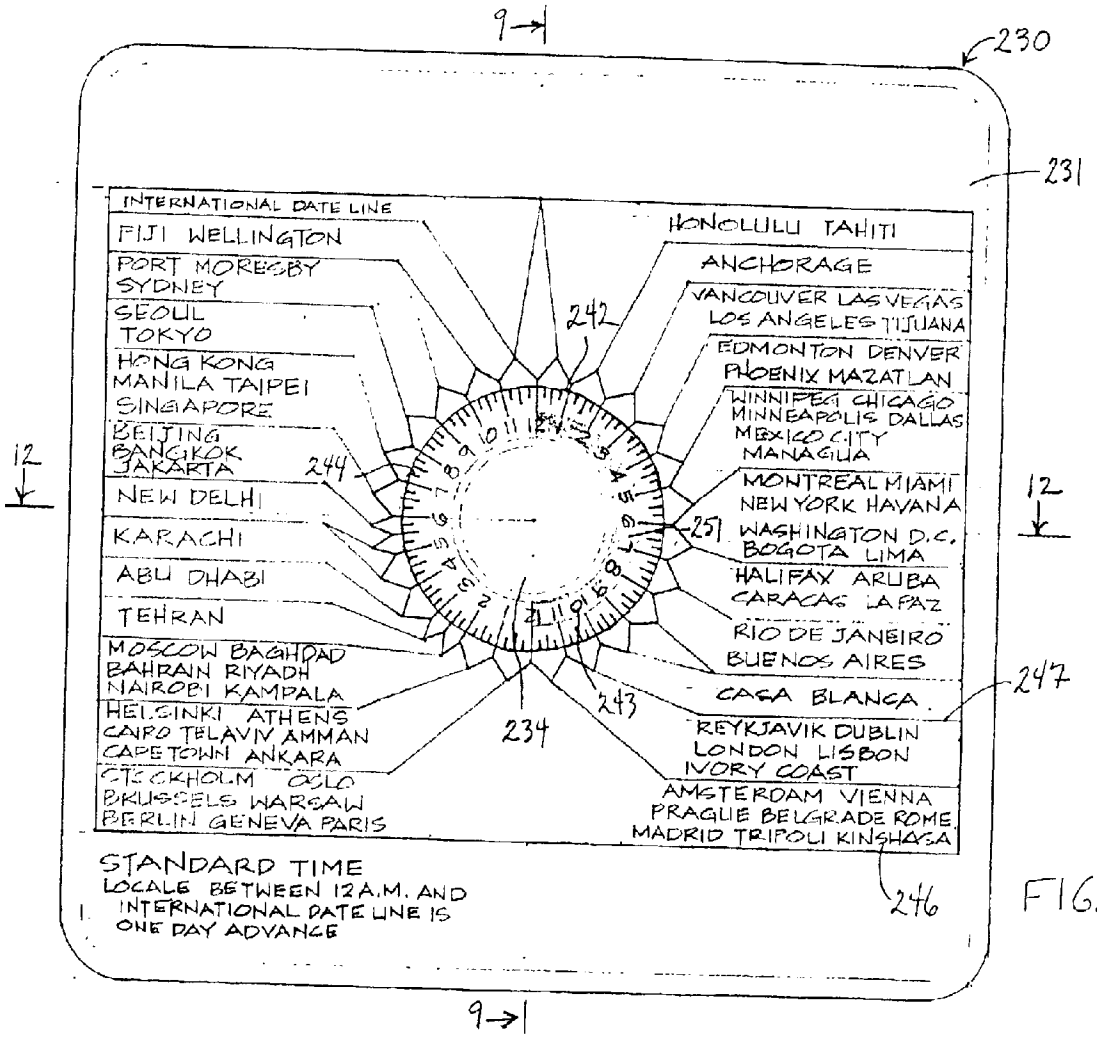
FIG. 7 is a front elevational view of a first modification of the global time indicator of FIG. 1.
Figure 10:
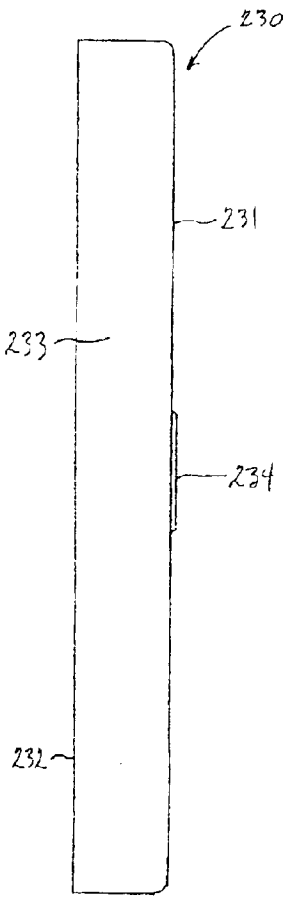
FIG. 10 is a left side view of FIG. 7.
Figure 9:
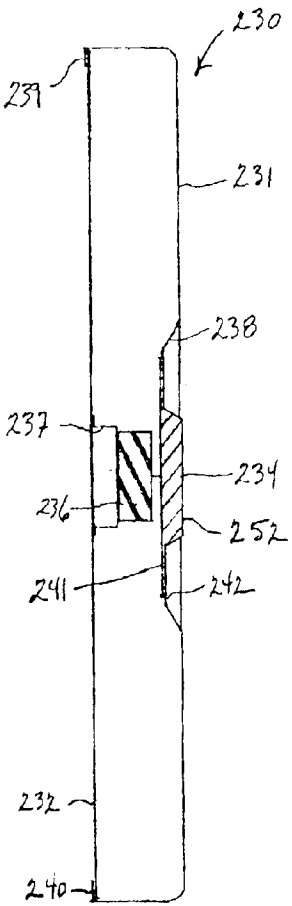
FIG. 9 is sectional view taken along line 9—9 of FIG. 7.
Figure 8:
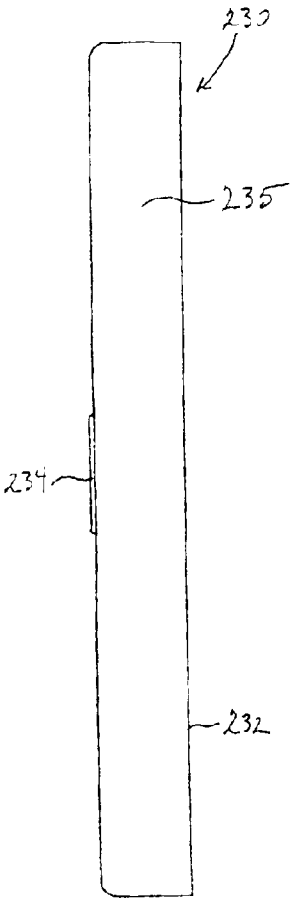
FIG. 8 is a right side view of FIG. 7.
Figure 11:
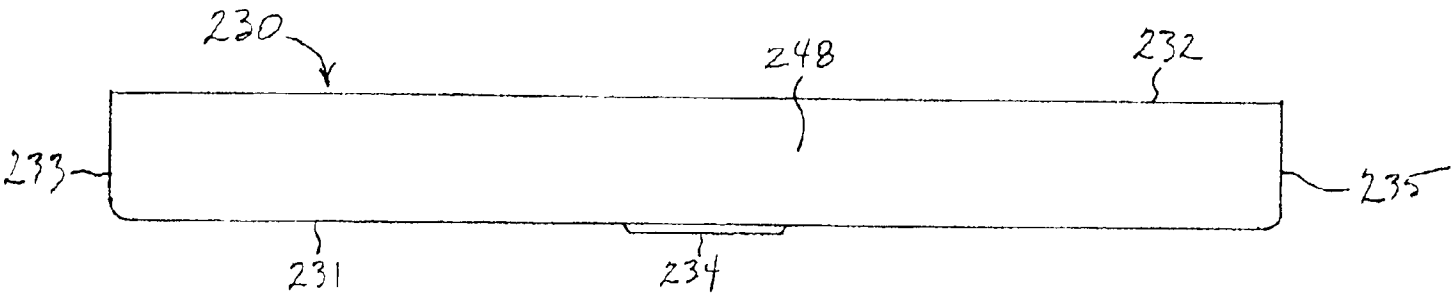
FIG. 11 is a top plan view of FIG. 7.
Figure 12:
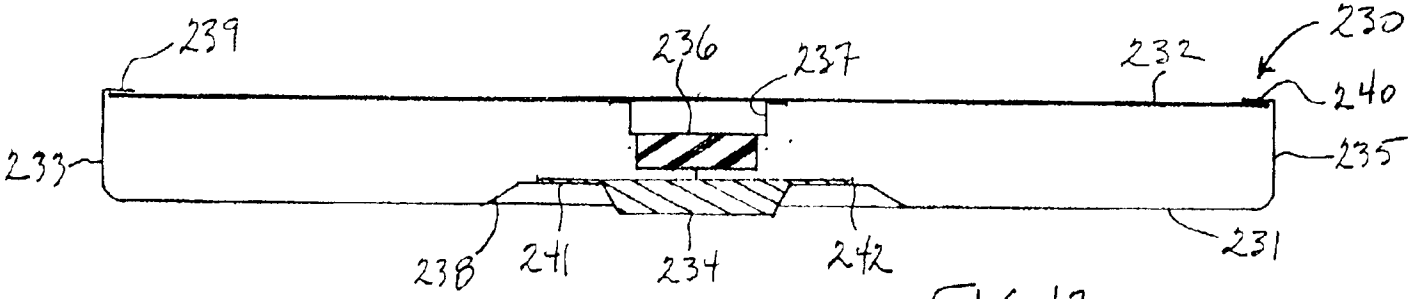
FIG. 12 is a sectional view taken along line 12—12 of FIG. 7.
Figure 13:
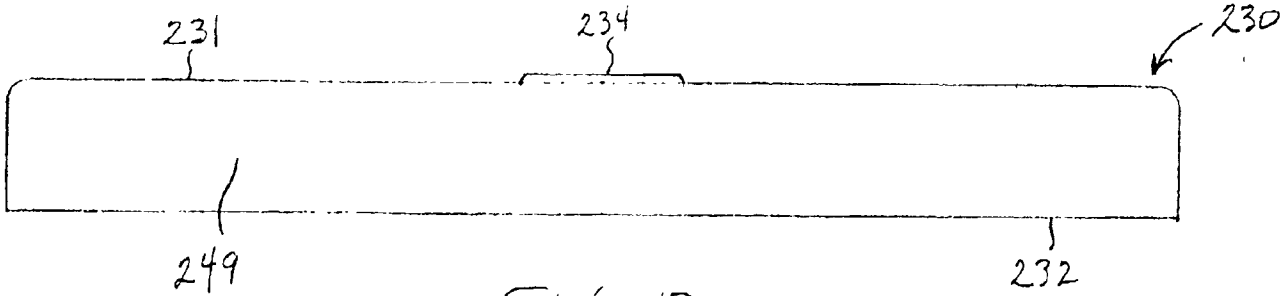
FIG. 13 is a bottom plan view of FIG. 7.

As shown in FIG. 6, indicator 130 has a template or front wall 131 having line indicia 142 and printed matter 141 referencing advanced time or daylight savings time. Wall 131 has grooves 136 to expose dial 133 rotatably mounted on indicator 130. The hub 134 of dial 133 has numerical indicia 138 and scale indicia 139 to indicate time of day. Wall 131 has a center opening 143 to accommodate hub 134 and expose indicia 138 and 139. When dial 133 is moved to indicate present local time, times of various other localities are indicated. The center 144 of hub 134 of dial 133 can be have advertising matter printed thereon. Slot 137 through indicator 130 can be used to accommodate a chain or strap for attachment to luggage and the like. The back wall of indicator 130 can have indicia and printed matter similar to line indicia 42 and printed matter 41 of indicator 30 referencing standard time.

A first modification of the indicator, indicated generally at 230, is shown in FIGS. 7 to 13. Indicator 230 is a wall mounted global time indicating device having a generally flat rectangular shape. Indicator 230 has a pan-shaped cover 231 having rearwardly extended side walls 233 and 235, top wall 248 and bottom wall 249. Cover 231 is joined to a relatively flat back wall 232. Legs 239 and 240 of cover 231 overlap the outer edges of back wall 232 to hold cover 231 in assembled relation with wall 232. The front of cover 231 has an inwardly directed recess 238 having a centrally located opening 242. A dial 234 rotatably mounted on a clock mechanism 236 extends through opening 242. A bracket 237 connected to clock mechanism 236 is mounted on back wall 232 to support clock mechanism 236 adjacent dial 234. Dial 234 has an outer annular ring 241 having an outer surface with numerical indicia 243 and scale indicia 244 to indicate a 24-hour time period in 15-minute increments. Clock mechanism 236 has a gear down ration of 2:1 whereby dial 234 is rotated counterclockwise once in one 24-hour period. Numerical indicia 243 on ring 241 have two 12-hour periods. An inner portion of ring 241 has a C-shaped shaded portion 251 to differentiate afternoon and evening periods of time from morning periods of time. It may be desirable to have numerical indicia indicating one 24-hour military time period. It also may be desirable to have the center of dial 234 remain stationary while ring 241 rotates relative to dial 234. As shown in FIG. 6, the center of dial 234 has a generally flat outer surface 252 extended outwardly from ring 241 and cover 231. Advertising indicia or logos may be imprinted on outer surface 252. A light (not shown) can be used to illuminate dial 234.

Figure 14:
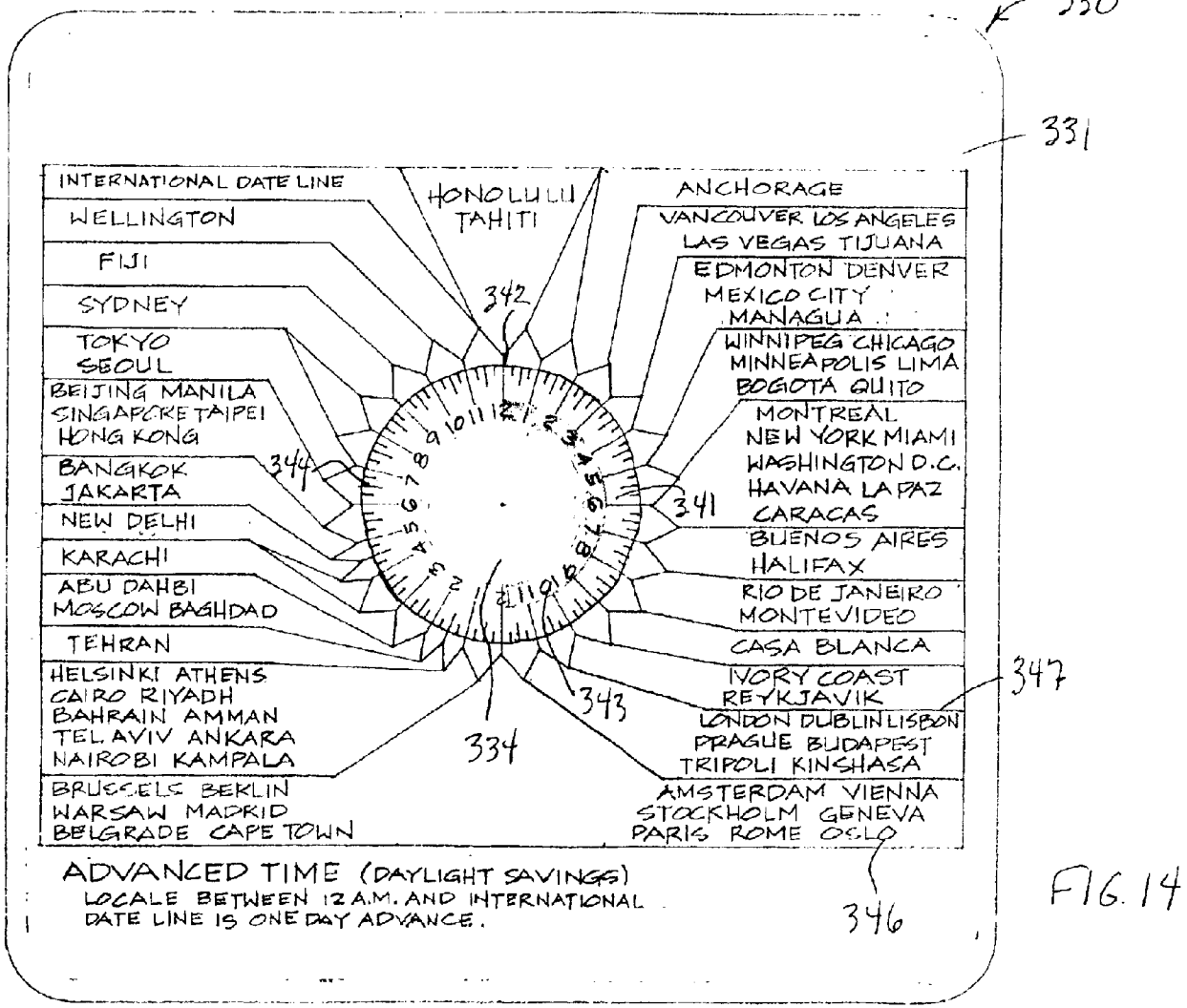
FIG. 14 is a front elevational view of the global time indicator of FIG. 7 having indicia indicating advanced time.

As shown in FIG. 14, indicator 330 is a wall mounted global time indicating device substantially the same as indicator 230 having a cover 331 having printed matter 346 and line indicia 347 indicating advanced time or daylight time. Cover 331 is interchangeable with cover 231 of indicator 230. Printed matter 346 and line indicia 347 are referenced with numerical indicia 343 and scale indicia 344 of rotating dial 334 to calculate international time zones during advanced time periods.

Figure 15:
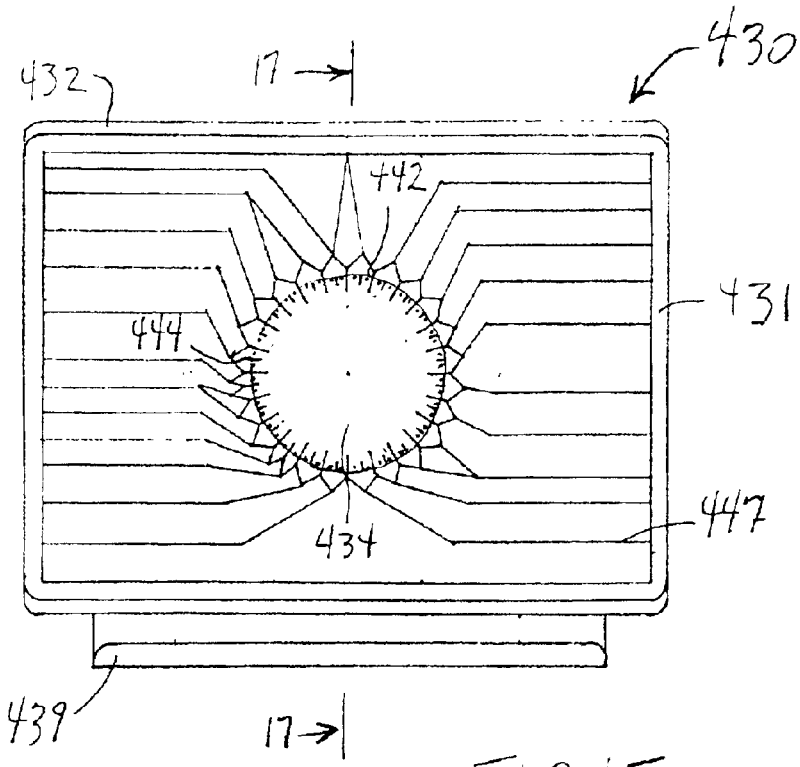
FIG. 15 is a front elevational view of a second modification of FIG. 1.
Figure 16:
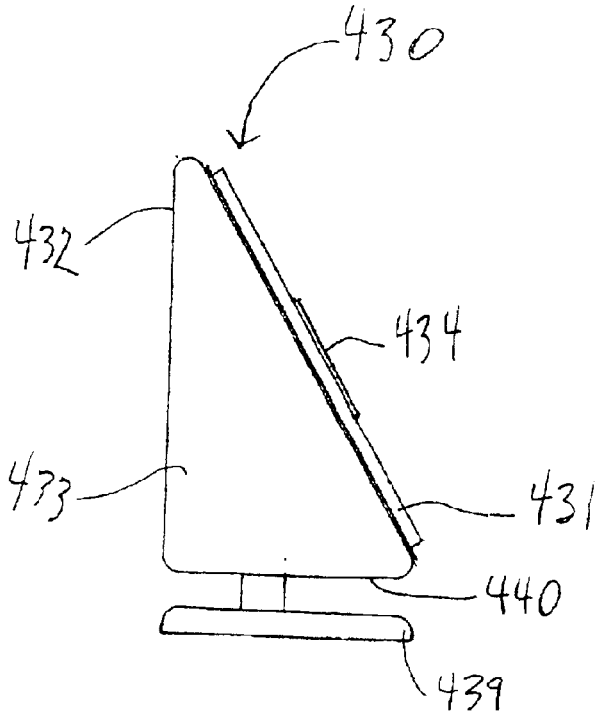
FIG. 16 is a side view of FIG. 15.
Figure 17:
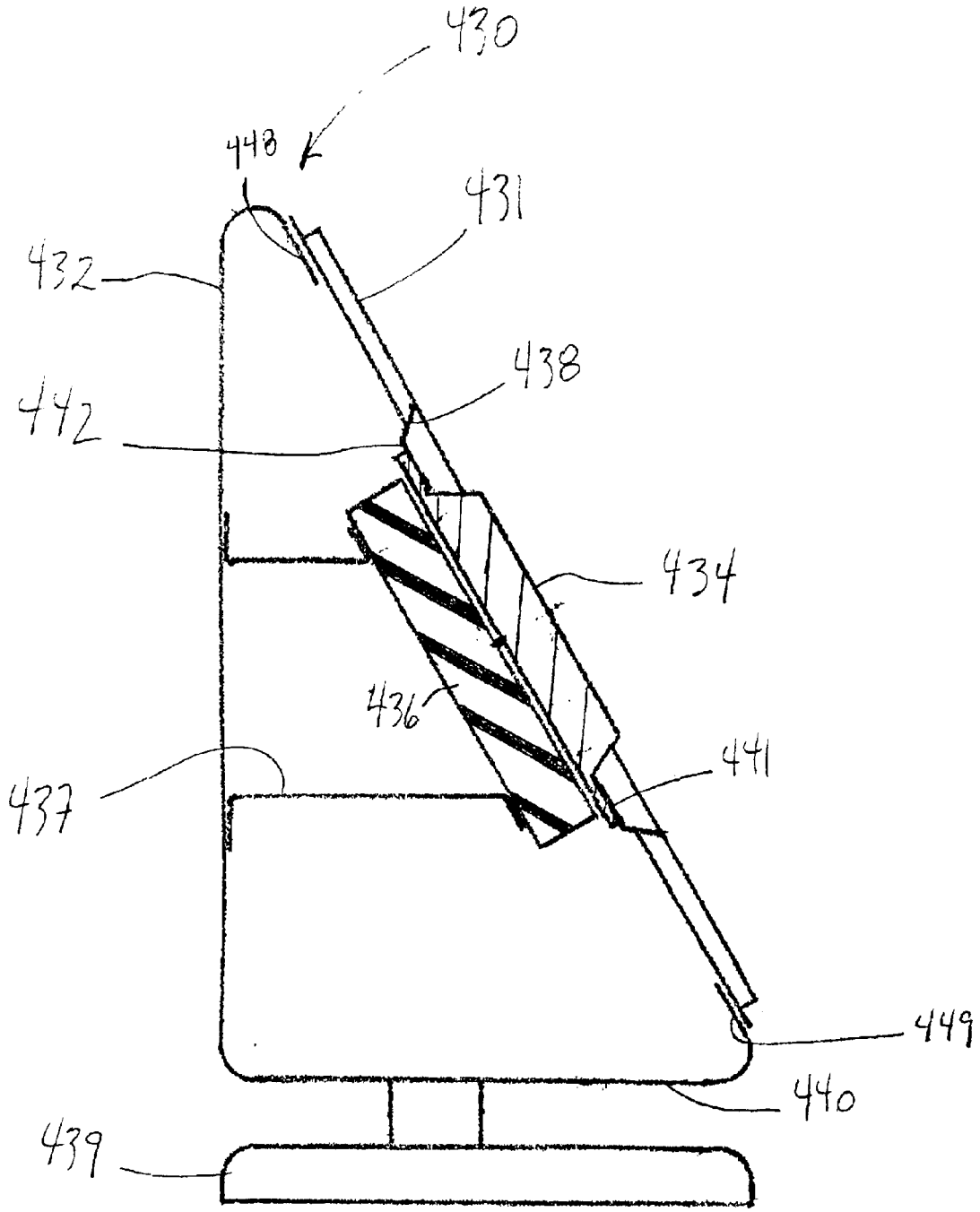
FIG. 17 is an enlarged sectional view taken along line 17—17 of FIG. 15.

A second modification of the indicator, indicated generally at 430, shown in FIGS. 15 to 17, is used to indicate time of day at various worldwide localities similar to indicator 230. Indicator 430 has a front wall or cover 431 having line indicia 447 forming boxes indicating a plurality of time zones throughout the world. Printed matter located on cover 431 (not shown) identifies localities within each time zone whereby quick reference may be made to determine time of day at a selection locale. Scale indicia 444 on dial 434 is used to indicate a specific time of day. Cover 431 is joined to a back wall 432, sidewalls 433 and bottom wall 440 forming an inner chamber housing a clock mechanism 436. A bracket 437 connected to back wall 432 supports clock mechanism 436 in an inclined relation adjacent dial 434. Clock mechanism 436 is operatively connected to dial 434 and functions to rotate the dial counterclockwise once during one 24-hour period. Cover 431 has a centrally located recess 438 having an opening 442. Dial 434 extends through opening 442. Dial 434 has the same inclined relation as cover 431. Indicator 430 has a pair of inclined forward lips 448 and 449 connected to cover 43l whereby cover 431 and dial 434 slope rearwardly to facilitate visibility of indicia 444 and 447 and the printed matter located thereon. Indicator 430 has a stand or base 439 to support the indicator on a horizontal surface such as an office desk top, kitchen counter top, and the like.

There has been shown and described embodiments of the global time indicator of the invention. Changes in the materials, structures, markings, and arrangement of structures may be made by persons skilled in the art without departing from the invention.

What is claimed is:

1. A device to calculate local time in different geographical regions of the world comprising: a generally flat front wall joined to a generally flat back wall, a rotatable member layered between the front and back walls, the rotatable member having an outer annular edge and a centrally located generally circular outwardly projecting hub having a generally flat outer surface, time indicia indicating a 24-hour period of time located on the outer surface of the hub, the front wall having a flat outer surface substantially flush with the outer surface of the hub and a generally circular opening accommodating the hub and exposing the time indicia, line indicia located on the outer, surface of the front wall forming a plurality of generally rectangular vertically disposed sections adjacent the hub, each section representing a geographical region within which a uniform time is used, the section containing horizontally disposed printed matter identifying localities within the geographical region, and groove means in the front and back walls exposing a portion of the outer annular edge of the rotatable member for manual rotation of the rotatable member, the rotatable member manually rotatable in opposite directions to selectively move time indicia representing the time of day at a selected locality adjacent the section representing the geographical region of the selected locality whereby the time of day of one or more other localities designated by the printed matter located in another section can be determined, and means for aligning the time indicia with each section.

2. The device of claim 1 wherein: the line indicia includes a plurality of vertically spaced linear segments extended perpendicular to the longitudinal axis of the rotatable member.

3. The device of claim 1 wherein: the the outer surface of the hub has a first portion having time indicia indicating a first 12-hour period of time and a second portion having time indicia indicating a second 12-hour period of time, and a shaded portion to differentiate the first portion from the second portion.

4. The device of claim 1 wherein: the means for aligning the time indicia with each section includes Y-shaped angle bracket members closing the ends of the sections adjacent the time indicia located on the outer surface of the hub to facilitate alignment of a desired time indicia with a particular section.

5. The device of claim 1 wherein: the front and back walls have aligned slot means for accommodating attachment means.

6. The device of claim 1 wherein: the groove means comprises recesses in opposite top and bottom side edges of the front and back walls to expose outer peripheral top and bottom portions of the outer annular edge of the rotatable member.

7. A device to calculate local time in different geographical regions of the world comprising: a front wall having a centrally located opening, a rotatable member located adjacent the front wall, the rotatable member having time indicia representing the time of day visible through the opening indicating first and second 12-hour periods of time, the front wall having line indicia forming first and second columns of vertically disposed generally rectangular shaped boxes on opposite sides of the front wall, each box representing a geographical region within which a uniform time is recognized, horizontally disposed printed matter located in the box identifying localities within the geographical region, the rotatable member movable to move time indicia for a selected time of day of a selected locality adjacent the box representing the geographical region of the selected locality whereby the time of day of one or more other localities designated by the printed matter located in another box can be determined.

8. The device of claim 7 wherein: the line indicia includes a plurality of vertically spaced linear segments extended perpendicular to the longitudinal axis of the rotatable member.

9. The device of claim 7 wherein: each box has a Y-shaped closed end located adjacent the time indicia to facilitate alignment of a desired time indicia with the box.

10. The device of claim 7 wherein: the first column of boxes is associated with the first 12-hour period of time, the second column of boxes being associated with the second 12-hour period of time.

11. The device of claim 7 wherein: the rotatable member has an outwardly projecting member accommodated by the opening in the front wall, the time indicia imprinted on the outwardly projecting member, the outwardly projecting member having an outer annular surface bearing against an annular surface surrounding the opening to hold the rotatable member in assembled relation.

12. The device of claim 7 including: clock means operably connected to the rotatable member to rotate the rotatable member one revolution during the first and second 12-hour periods of time.

13. A manually operated global time indicating device for calculating international time comprising: a generally flat first wall joined to a generally flat second wall, a generally circular member rotatably mounted in sliding engagement with the first and second walls, the circular member having a centrally located outwardly projecting hub, the first wall having an opening accommodating the hub, the hub having an outer annular surface bearing against an annular surface surrounding the opening to hold the circular member in assembled relation, the first wall having line indicia forming first and second columns of vertically disposed generally rectangular shaped boxes on opposite sides of the front wall, each box representing a geographical region within which a uniform time is recognized, printed matter contained within the box identifying localities within the geographical region, the circular member movable to move time indicia printed on the outer face of the hub adjacent the box whereby the time of day of other localities identified by the printed matter contained within another box can be determined.

14. The device of claim 13 wherein: the line indicia includes a plurality of vertically spaced linear segments extended perpendicular to the longitudinal axis of the circular member.

15. The device of claim 13 wherein: each box has a Y-shaped closed end located adjacent the time indicia to facilitate alignment of a desired time indicia with the box.

* * * * *